US010113501B2

(12) United States Patent
Mori et al.

(10) Patent No.: US 10,113,501 B2
(45) Date of Patent: Oct. 30, 2018

(54) COOLING STRUCTURE OF ENGINE

(71) Applicant: Mazda Motor Corporation, Aki-gun, Hiroshima (JP)

(72) Inventors: Uichiro Mori, Hiroshima (JP); Yoshiaki Hayamizu, Higashihiroshima (JP); Daisuke Tabata, Hiroshima (JP); Daisuke Matsumoto, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 15/484,686

(22) Filed: Apr. 11, 2017

(65) Prior Publication Data

US 2017/0298858 A1 Oct. 19, 2017

(30) Foreign Application Priority Data

Apr. 19, 2016 (JP) ..... 2016-083747

(51) Int. Cl.

| | |
|---|---|
| ***F02F 1/14*** | (2006.01) |
| ***F02F 1/40*** | (2006.01) |
| ***F01P 3/02*** | (2006.01) |

(52) U.S. Cl.

CPC ..... *F02F 1/14* (2013.01); *F01P 3/02* (2013.01); *F02F 1/40* (2013.01); *F01P 2003/021* (2013.01)

(58) Field of Classification Search

CPC ..... F02F 1/40; F02F 1/004; F02F 1/14; F01P 7/14; F01P 5/10; F01P 2003/028; F01P 2003/027; F01P 2003/024; F01P 2003/021; F01P 3/02

See application file for complete search history.

(56) References Cited

U.S. PATENT DOCUMENTS

2015/0377114 A1* 12/2015 Matsumoto ..... F02F 1/14 123/41.44

FOREIGN PATENT DOCUMENTS

JP 2015108346 A 6/2015

* cited by examiner

*Primary Examiner* — Jacob Amick

(74) *Attorney, Agent, or Firm* — Alleman Hall Creasman & Tuttle LLP

(57) ABSTRACT

A cooling structure of an engine is provided, which includes a water jacket formed in a cylinder block to surround a cylinder bore of the engine, a spacer having a vertical wall surface and inserted into the water jacket, and a coolant inlet formed in an outer wall of the water jacket, and for circulating to the water jacket coolant introduced from the coolant inlet. The vertical wall surface surrounds the cylinder bore. The spacer includes a guide part provided at a position of a lower end part of the vertical wall surface corresponding to the coolant inlet, and for guiding the coolant introduced from the coolant inlet to flow around the vertical wall surface. The guide part extends outwardly from the lower end part of the vertical wall surface toward the coolant inlet along a bottom wall of the water jacket.

4 Claims, 17 Drawing Sheets

COOLING STRUCTURE OF ENGINE

BACKGROUND

The present invention relates to a cooling structure of an engine, and particularly to a cooling structure of an engine which includes a spacer inserted into a water jacket of a cylinder block of the engine.

Generally, vehicles with an engine are formed with water jackets for flowing coolant in the engine cylinder block and cylinder head. The coolant is introduced from the cylinder block at one end in a cylinder line-up direction into the water jacket of the cylinder block, and circulated inside the water jacket of the cylinder block and then into the water jacket of the cylinder head, so as to cool the part of the engine near combustion chambers.

Generally, the coolant circulated inside the water jackets of the cylinder block and the cylinder head is discharged to a radiator from the cylinder head at the other end in the cylinder line-up direction, cooled by the radiator, and then introduced into the water jacket of the cylinder block again from the one end of the cylinder block by a water pump.

In the case of cooling by the circulation of the introduced coolant to the water jackets of the cylinder block and the cylinder head as described above, an upper part of an inner wall of the water jacket of the cylinder block near the combustion chambers increases in temperature more than a lower part thereof. Therefore, the upper part is required to be cooled more than the lower part.

For example, JP2015-108346A discloses a structure in which a spacer having a vertical wall surface is inserted into a water jacket of a cylinder block to surround cylinder bores. Coolant is introduced from a coolant inlet formed in an outer wall of the water jacket of the cylinder block, and the coolant flow is rectified so that the coolant flows on an outer circumferential side of the vertical wall surface of the spacer in a lower part of the water jacket and also flows on an inner circumferential side of the vertical wall surface of the spacer in an upper part of the water jacket. Thus, an upper part of an inner wall of the water jacket of the cylinder block is cooled more than a lower part thereof.

Further, the vehicles with the engine require a boosted engine warm-up in a cold start and a quick finish of the warm-up in view of fuel consumption and exhaust emission performances, while cooling the upper part of the inner wall of the water jacket of the cylinder block near the combustion chambers more than the lower part.

When the coolant is introduced from the coolant inlet to the outer circumferential side of the vertical wall surface of the spacer in the water jacket of the cylinder block, it may flow into a section between the vertical wall surface of the spacer and the inner wall of the water jacket of the cylinder block from the lower side of the spacer. Thus, the coolant may excessively cool the lower part of the inner wall of the water jacket of the cylinder block and the engine warm-up in the cold start may not be finished quickly enough.

The structure disclosed in JP2015-108346A is provided with a guide part extending toward the coolant inlet in a vertical center part of the vertical wall surface of the spacer to reduce the coolant flow into the inner circumferential side from the lower side of the spacer after being introduced from the coolant inlet. However, the coolant introduced from the coolant inlet along the guide part may flow around the vertical wall surface as well as flow downwardly on both sides of the guide part, and reach between the vertical wall surface of the spacer and the inner wall of the water jacket of the cylinder block from the lower side of the spacer. For this reason, a further improvement is desired.

SUMMARY

The present invention is made in view of the above issues and aims to provide a cooling structure of an engine, which reduces a flow of coolant into a section between a vertical wall surface of a spacer and an inner wall of a water jacket of a cylinder block from a lower side of the spacer.

According to one aspect of the present invention, a cooling structure of an engine is provided, which includes a water jacket formed in a cylinder block to surround a cylinder bore of the engine, a spacer having a vertical wall surface and inserted into the water jacket, and a coolant inlet formed in an outer wall of the water jacket, and for circulating to the water jacket coolant introduced from the coolant inlet. The vertical wall surface surrounds the cylinder bore. The spacer further includes a guide part provided at a position of a lower end part of the vertical wall surface corresponding to the coolant inlet, and for guiding the coolant introduced from the coolant inlet to flow around the vertical wall surface. The guide part extends outwardly from the lower end part of the vertical wall surface toward the coolant inlet along a bottom wall of the water jacket of the cylinder block.

Thus the coolant introduced from the coolant inlet is guided to flow around the vertical wall surface by the guide part provided at the position of the lower end part of the vertical wall surface of the spacer to extend toward the coolant inlet along the bottom wall of the water jacket. Therefore, a downward flow of the coolant from both sides of the guide part is reduced and a coolant flow into a section between the vertical wall surface of the spacer and an inner wall of the water jacket of the cylinder block from the lower side of the spacer is reduced.

A water pump may be attached to the coolant inlet of the cylinder block. The coolant inlet and the water pump may be provided at the same height as the bottom wall of the water jacket of the cylinder block.

According to the above structure, the coolant inlet and the water pump are provided at the same height as the bottom wall of the water jacket of the cylinder block. Thus, interference between an intake system and an exhaust system of the engine is avoided. Additionally, when the water pump is attached at the same height as the bottom wall of the water jacket, the flow of the coolant introduced from the coolant inlet into the section between the vertical wall surface of the spacer and the inner wall of the water jacket of the cylinder block from the lower side of the spacer is reduced.

A concaved section may be formed in the bottom wall of the water jacket of the cylinder block to dent downward of the coolant inlet. The guide part may extend into the concaved section from the lower end part of the vertical wall surface.

According to the above structure, the concaved section denting downward of the coolant inlet is formed in the bottom wall of the water jacket of the cylinder block. The guide part extends from the lower end part of the vertical wall surface into the concaved section. Thus, the coolant is guided to flow around the vertical wall surface while preventing an increase in flow resistance of the coolant introduced from the coolant inlet.

The guide part may include an inclining portion inclining downwardly while extending toward a coolant inlet side.

The inclining portion may be provided so that a part thereof on the coolant inlet side is disposed within the concaved section.

According to the above structure, the guide part includes the inclining portion inclining downwardly as it extends toward the coolant inlet. The inclining portion is provided so that the part on the coolant inlet side is disposed within the concaved section. Thus, also when the spacer moves vertically inside the water jacket, the increase in the flow resistance of the coolant introduced from the coolant inlet is prevented.

The spacer may include a flange part disposed adjacently to the guide part in the lower end part of the vertical wall surface and extending outwardly from the vertical wall surface to approach the outer wall of the water jacket of the cylinder block. The flange part and the guide part may be formed continuously with each other in the lower end part of the vertical wall surface.

According to the above structure, the flange part extending outwardly from the vertical wall surface adjacently to the guide part to approach the outer wall of the water jacket of the cylinder block is provided to the lower end part of the vertical wall surface of the spacer. The flange part and the guide part are formed continuously with each other in the lower end part of the vertical wall surface. Thus, the coolant flow into the section between the vertical wall surface of the spacer and the inner wall of the water jacket of the cylinder block from the lower side of the spacer is effectively reduced.

DETAILED DESCRIPTION OF EMBODIMENT

Hereinafter, one embodiment of the present invention is described with reference to the accompanying drawings.

Figure 1:
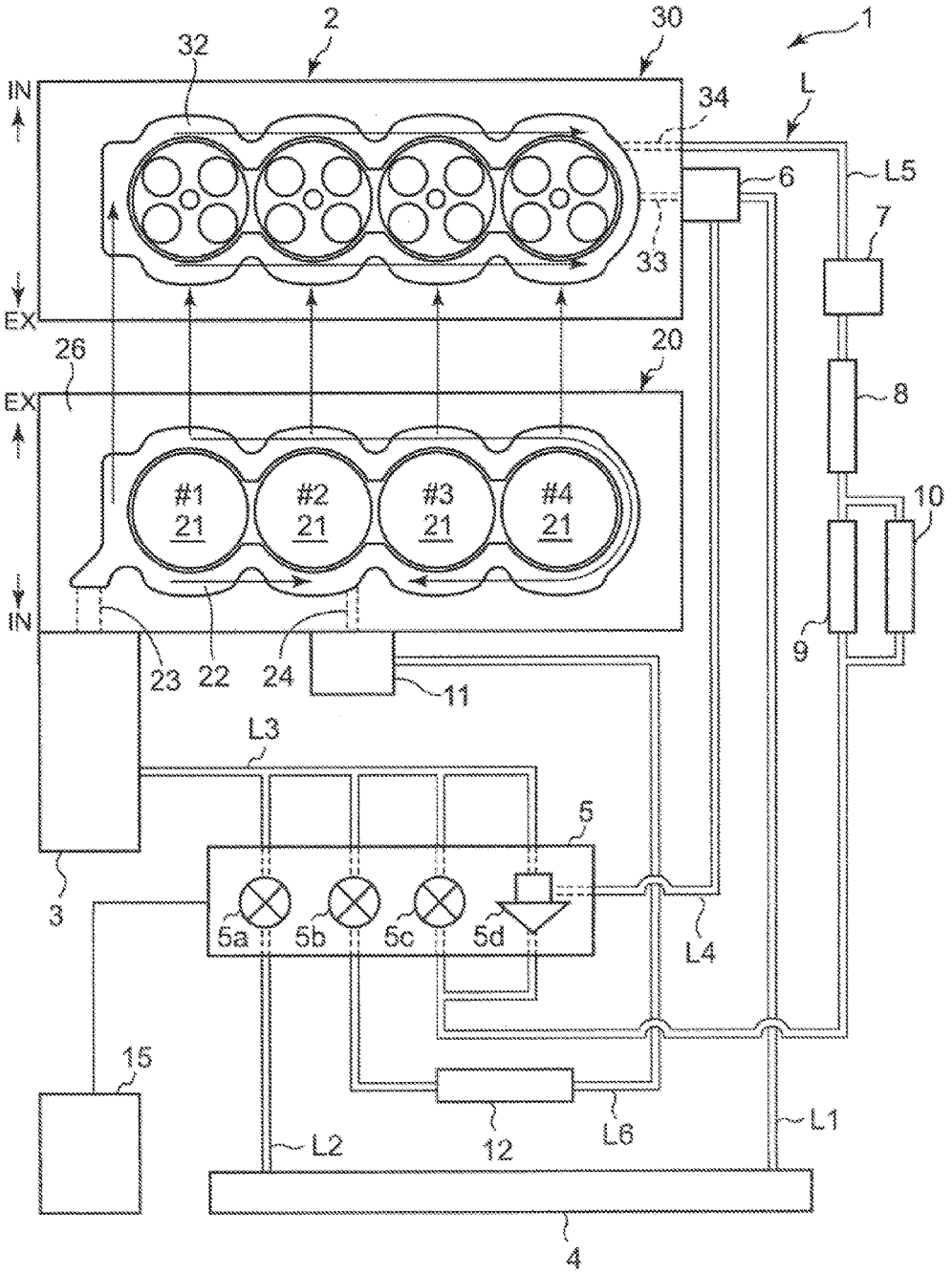
FIG. 1 is a schematic view illustrating a cooling structure of an engine according to one embodiment of the present invention.

FIG. 1 is a schematic view illustrating a cooling structure 1 of an engine 2 according to this embodiment. Note that in FIG. 1 as well as FIGS. 2 to 8, an intake side of a cylinder block and a cylinder head is denoted as "IN," and an exhaust side of the cylinder block and the cylinder head is denoted as "EX."

As illustrated in FIG. 1, the cooling structure 1 of the engine of this embodiment includes a coolant path L extending through a water jacket 22 formed in a cylinder block 20 to surround cylinder bores 21 of a plurality of cylinders #1, #2, #3 and #4 arranged in a line in this order, and a water jacket 32 formed in a cylinder head 30 coupled to the cylinder block 20. In the coolant path L, coolant is circulated by a water pump 3 through the water jacket 22 of the cylinder block 20, the water jacket 32 of the cylinder head 30, and a radiator 4 for cooling the coolant.

The engine 2 is a multi-cylinder engine, specifically an inline four-cylinder engine provided with the four cylinders #1 to #4 arranged inline, and the cylinder block 20 is formed with the water jacket 22 extending annularly to surround the cylinder bores 21 of the four cylinders #1 to #4.

In the cylinder block 20, a coolant inlet 23 for introducing the coolant to the water jacket 22 of the cylinder block 20 is formed on one end side in the cylinder line-up direction, specifically on the first cylinder #1 side (hereinafter, may be referred to as "the first end side"). The coolant inlet 23 is formed in an outer wall 26 of the water jacket 22 at a position on the intake side and the first end side, to extend from the intake to exhaust side. The water pump 3 is attached to the coolant inlet 23 of the cylinder block 20.

Further in the cylinder block 20, a cylinder-block-side discharging section 24 for discharging the coolant from the water jacket 22 is formed on the intake side, at a lower position of a center part of the outer wall 26 in the cylinder line-up direction. An oil cooler 11 is attached to the cylinder-block-side discharging section 24 of the cylinder block 20.

Figure 2:
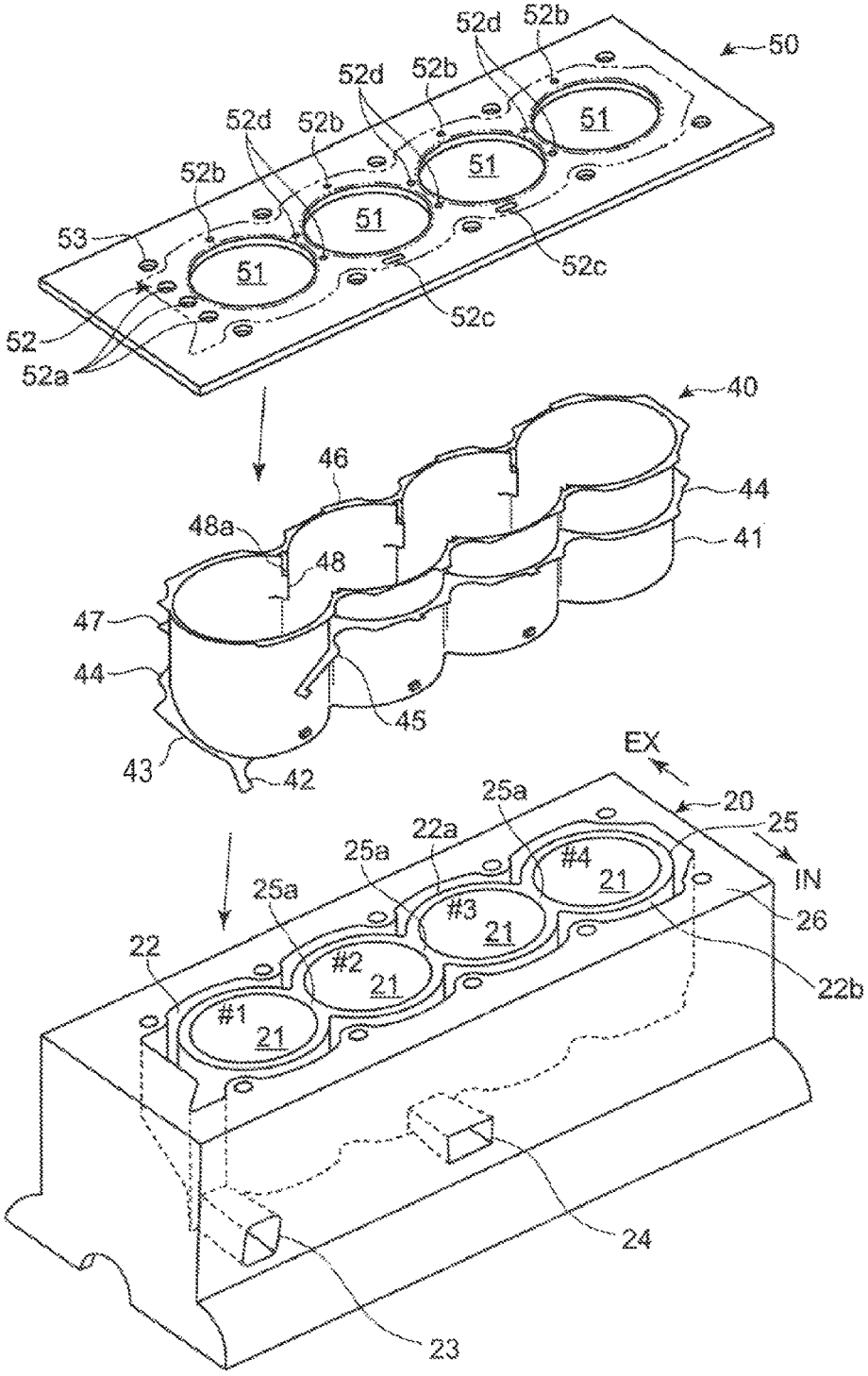
FIG. 2 is a view illustrating a cylinder block, a spacer, and a gasket of the engine according to this embodiment.

The cylinder block 20 and the cylinder head 30 are coupled to each other, sandwiching therebetween a gasket 50 which is illustrated in FIG. 2 (described later). The water jacket 22 of the cylinder block 20 communicates with the water jacket 32 of the cylinder head 30 through communication holes 52 formed in the gasket 50.

Therefore, the coolant introduced into the first end side of the water jacket 22 of the cylinder block 20 flows to the water jacket 32 of the cylinder head 30 through the communication holes 52, as well as it circulates in the water jacket 22 of the cylinder block 20 and is discharged from the center part through the cylinder-block-side discharging section 24.

The water jacket 32 of the cylinder head 30 is formed over the entire cylinder line-up from the first end side to the other end side (second end side) to cover intake ports, exhaust ports, plug ports (not illustrated), etc. of the cylinders #1 to #4.

The cylinder head 30 is formed with first and second cylinder-head-side discharging sections 33 and 34 for discharging the coolant from the water jacket 32 to the second end side, specifically to the fourth cylinder #4 side. The coolant introduced from the water jacket 22 of the cylinder block 20 to the water jacket 32 of the cylinder head 30 circulates in the water jacket 32 and is discharged from the second end side through the first and second cylinder-head-side discharging sections 33 and 34.

The coolant discharged from the first cylinder-head-side discharging section 33 flows to the radiator 4 through a temperature detecting unit 6 provided with a temperature detecting sensor (not illustrated) for detecting a temperature of the coolant, and a coolant path L1 connecting the first cylinder-head-side discharging section 33 with the radiator 4. The coolant is cooled by the radiator 4 and then flows to a valve unit 5 through a coolant path L2 connecting the radiator 4 with the valve unit 5.

The valve unit 5 includes a first flow rate control valve 5*a*, a second flow rate control valve 5*b*, a third flow rate control valve 5*c*, and a thermostatic valve 5*d*. The first to third flow rate control valves 5*a* to 5*c* are controlled in open and close operations, and flow rates by a control device 15. The thermostatic valve 5*d* becomes an open state when the temperature of the coolant at the thermostatic valve 5*d* reaches a given temperature.

The coolant flowed to the valve unit 5 through the coolant path L2 flows to the water pump 3 through the first flow rate control valve 5*a* and a coolant path L3 connecting the valve unit 5 with the water pump 3. Then the coolant is introduced into the water jacket 22 of the cylinder block 20 by the water pump 3.

The coolant discharged from the first cylinder-head-side discharging section 33 also flows to the valve unit 5 through the temperature detecting unit 6 and a coolant path L4 connecting the first cylinder-head-side discharging section 33 with the valve unit 5. The coolant path L4 is connected with the coolant path L3 via the thermostatic valve 5*d*, and the coolant discharged from the first cylinder-head-side discharging section 33 flows to the water pump 3 through the temperature detecting unit 6, the coolant path L4, the thermostat valve 5*d*, and the coolant path L3. Then the water pump 3 introduces the coolant into the water jacket 22 of the cylinder block 20.

The coolant discharged from the second cylinder-head-side discharging section 34, on the other hand, flows to the valve unit 5 through a coolant path L5 connecting the second cylinder-head-side discharging section 34 with the valve unit 5. An auxiliary water pump 7 for supplementarily pumping the coolant, a heater unit 8 for exchanging heat between the coolant and air conditioning wind, an exhaust gas recirculation (EGR) cooler 9 for exchanging heat between the coolant and exhaust gas recirculated to the intake side, and an EGR valve 10 for controlling a supply amount of the coolant to the EGR cooler 9 are provided on the coolant path L5. The EGR cooler 9 and the EGR valve 10 constitute an EGR system for recirculating a portion of the exhaust gas to the intake side.

The coolant flowed to the valve unit 5 through the coolant path L5 flows to the water pump 3 through the third flow rate control valve 5*c* and the coolant path L3. Then the water pump 3 introduces the coolant into the water jacket 22 of the cylinder block 20.

The coolant which flows to the valve unit 5 through the coolant path L5 also flows through the thermostatic valve 5*d*. When the temperature of the coolant is the given temperature or above and the thermostatic valve 5*d* is in the open state, the coolant flows to the water pump 3 through the thermostatic valve 5*d* and the coolant path L3.

Moreover, the coolant discharged from the cylinder-block-side discharging section 24 formed in the cylinder block 20 flows to the valve unit 5 through a coolant path L6 connecting the cylinder-block-side discharging section 24 with the valve unit 5. The oil cooler 11 for exchanging heat between the coolant and engine oil, and an automatic transmission fluid (ATF) warmer 12 for exchanging heat between the coolant and ATF, which is an oil for automatic transmissions, are provided on the coolant path L6.

The coolant flowed to the valve unit 5 through the coolant path L6 flows to the water pump 3 through the second flow rate control valve 5*b* and the coolant path L3. Then the water pump 3 introduces the coolant into the water jacket 22 of the cylinder block 20.

Thus, the cooling structure 1 of the engine of this embodiment circulates the coolant introduced from the coolant inlet 23, which is formed in the outer wall 26 of the water jacket 22 of the cylinder block 20, to the water jacket 22 and the water jacket 32 of the cylinder head 30.

The control device 15 includes a processor and receives signals from a fuel injection amount sensor (not illustrated) for detecting a fuel injection amount, an engine speed sensor (not illustrated) for detecting an engine speed, the temperature detecting sensor for detecting the temperature of the coolant, etc. The control device 15 determines a load state of the engine 2 based on the fuel injection amount and the engine speed. The control device 15 estimates wall surface temperatures of combustion chambers of the engine 2 based on the detected coolant temperature and the determined load state of the engine 2. The control device 15 controls the flow rate control valves 5*a*, 5*b* and 5*c* according to the estimated wall surface temperatures of the combustion chambers of the engine 2.

The control device 15 controls all the first to third flow rate control valves 5*a* to 5*c* to close in a cold start of the engine 2, which corresponds to a state where the wall surface temperatures of the combustion chambers are below a first temperature (e.g., 150 degrees). The control device 15 controls the third flow rate control valve 5*c* to open when the wall surface temperatures become the first temperature or above. The control device 15 controls the second flow rate control valve 5*b* to open in addition to the third flow rate control valve 5*c* when the wall surface temperatures become a second temperature (higher than the first temperature) or above. The control device 15 controls the first flow rate control valve 5*a* to open in addition to the second and third flow rate control valves 5*b* and 5*c* when the wall surface temperatures become a third temperature (higher than the second temperature) or above.

When the estimated wall surface temperatures of the combustion chambers of the engine 2 are below the second temperature, the coolant introduced from the coolant inlet 23 into the water jacket 22 of the cylinder block 20, without being discharged through the cylinder-block-side discharging section 24, flows to the water jacket 32 of the cylinder head 30 through the communication holes 52 and is discharged from the cylinder-head-side discharging sections 33 and 34. On the other hand, when the estimated wall surface temperatures of the combustion chambers of the engine 2 are the second temperature or above, the coolant is discharged through the cylinder-block-side discharging section 24 as well as it flows to the water jacket 32 of the cylinder head 30 through the communication holes 52 and is discharged from the cylinder-head-side discharging sections 33 and 34.

FIG. 2 is a view illustrating the cylinder block, a spacer, and the gasket of the engine of this embodiment. As illustrated in FIG. 2, in the engine 2 of this embodiment, a spacer 40 having a vertical wall surface 41 is inserted into the water jacket 22 of the cylinder block 20, to surround the cylinder bores 21 of the four cylinders #1 to #4.

In the state where the spacer 40 is inserted into the water jacket 22, the gasket 50 is placed on the cylinder block 20 and the cylinder block 20 is coupled to the cylinder head 30 by fastening bolts (not illustrated) via the gasket 50. An outer circumferential part of the gasket 50 is formed with bolt through-holes 53 through which the fastening bolts are inserted, and an outer circumferential part of the cylinder block 20 is formed with bolt bores 29 (see FIG. 3) into which the fastening bolts are inserted.

The gasket 50 is also formed with four openings 51, each formed in a circle similarly to the cylinder bore 21, and the communication holes 52 communicating the water jacket 22 of the cylinder block 20 with the water jacket 32 of the cylinder head 30 and for allowing the coolant to flow therethrough. Note that in FIG. 2, the two-dotted chain line on the gasket 50 indicates the shape of the water jacket 22 of the cylinder block 20.

The communication holes 52 formed in the gasket 50 include, for example, three communication holes 52*a* disposed on the first end side where the coolant inlet 23 is formed, four communication holes 52*b* disposed on the exhaust side of the openings 51 formed corresponding to the four cylinders #1 to #4, two communication holes 52*c* disposed on the intake side of the openings 51 formed corresponding to two of the center-side cylinders (#2 and #3 in this embodiment), and six communication holes 52*d* disposed at the intake side and the exhaust side of inter-cylinder-bore portions 25*a* of the cylinder block 20.

The cooling structure of the engine of this embodiment is described more into detail with reference to FIGS. 3 to 17.

Figure 3:
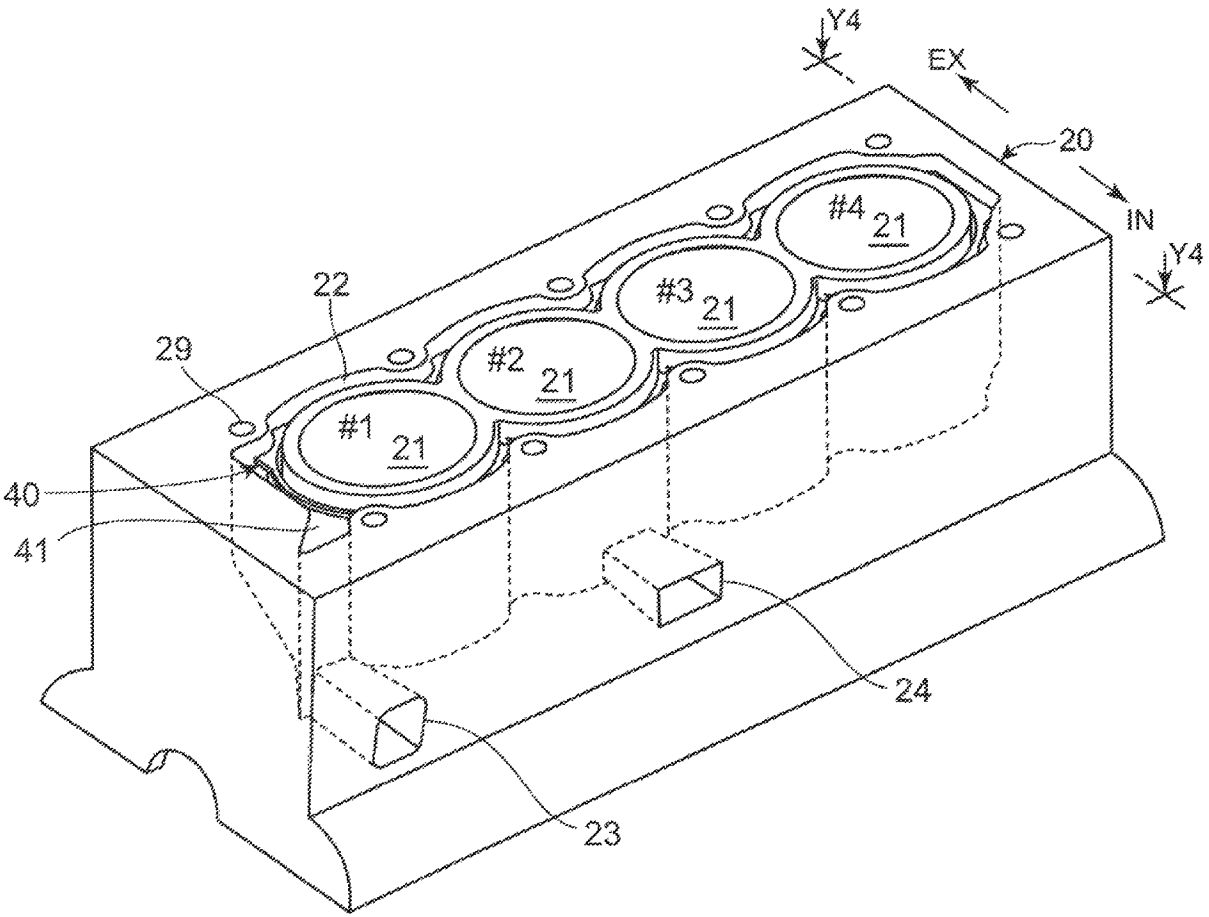
FIG. 3 is a perspective view illustrating the cylinder block into which the spacer is inserted.
Figure 4:
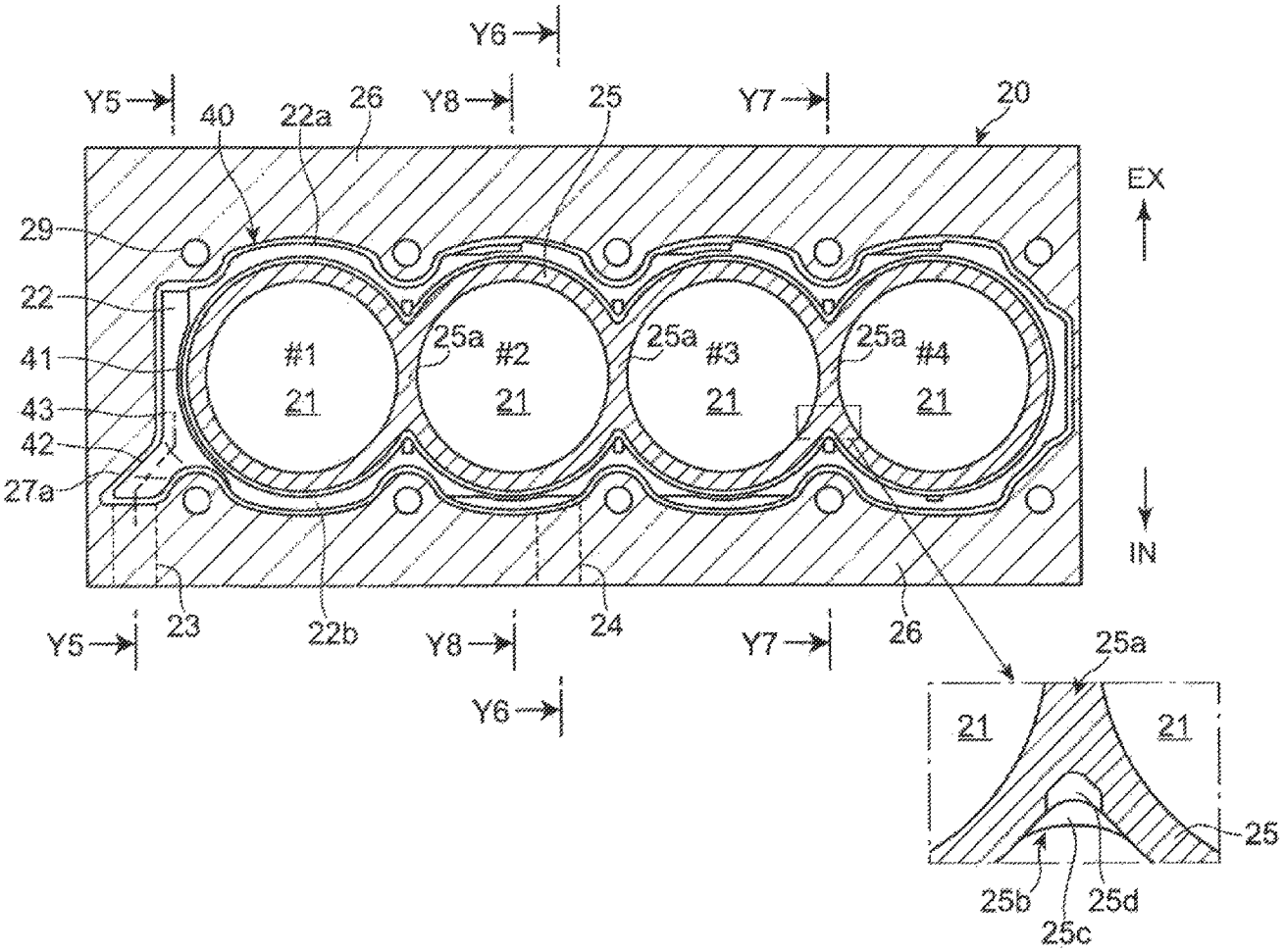
FIG. 4 is a cross-sectional view of the cylinder block taken along a line Y4-Y4 of FIG. 3.

FIG. 3 is a perspective view illustrating the cylinder block inserted therein with the spacer. FIG. 4 is a cross-sectional view of the cylinder block taken along a line Y4-Y4 of FIG. 3. FIGS. 5 to 8 are cross-sectional views of the cylinder block taken along lines Y5-Y5, Y6-Y6, Y7-Y7 and Y8-Y8 of FIG. 4, respectively.

Figure 5:
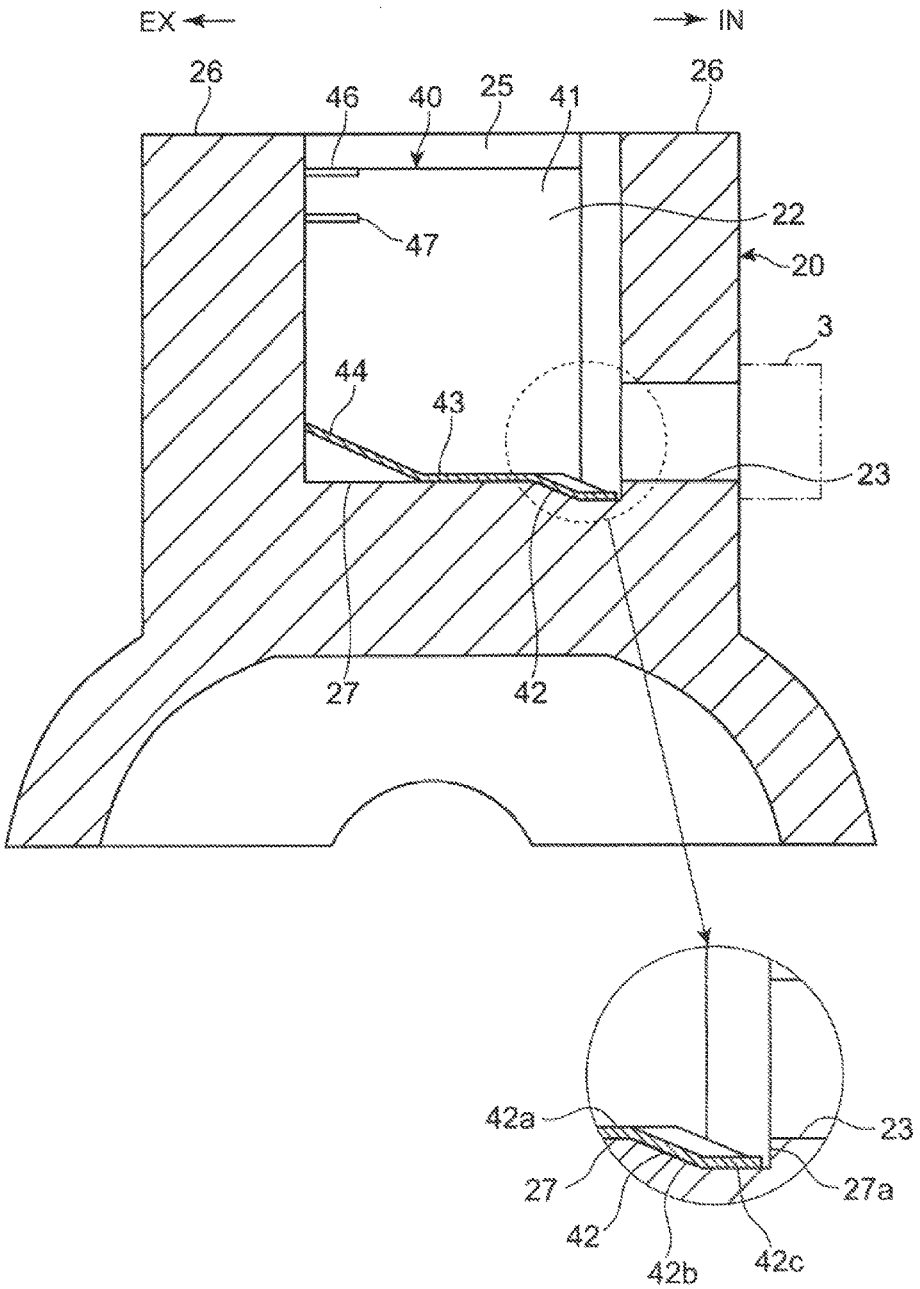
FIG. 5 is a cross-sectional view of the cylinder block taken along a line Y5-Y5 of FIG. 4.
Figure 6:
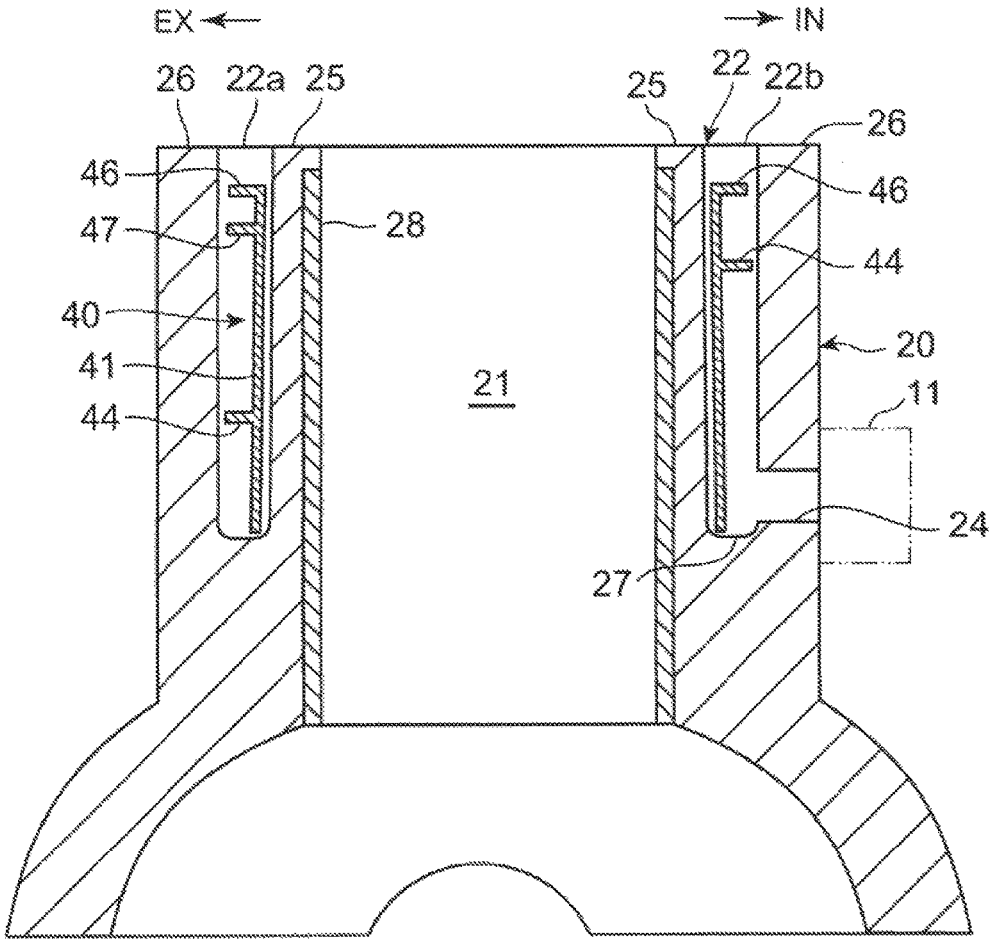
FIG. 6 is a cross-sectional view of the cylinder block taken along a line Y6-Y6 of FIG. 4.
Figure 7:
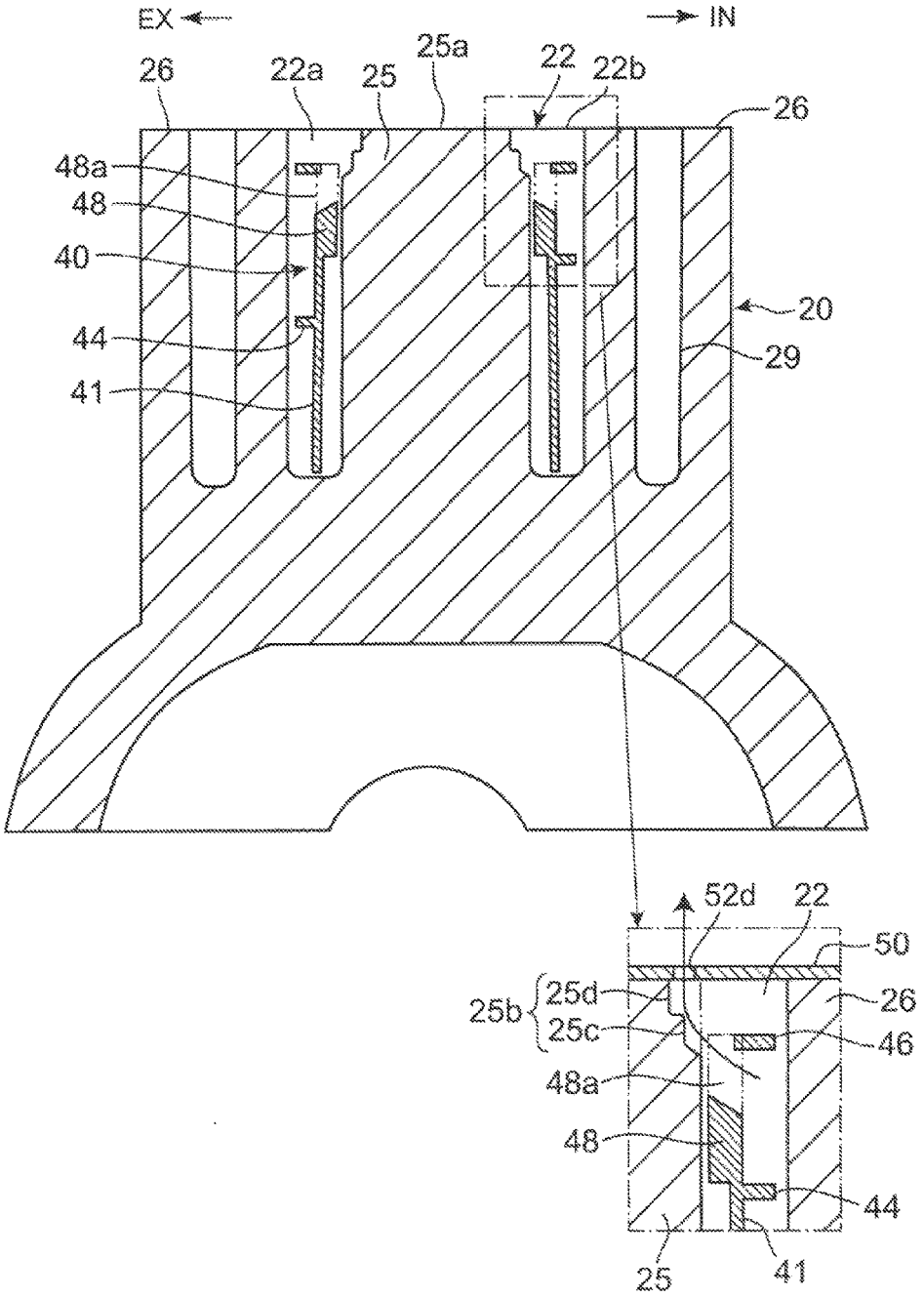
FIG. 7 is a cross-sectional view of the cylinder block taken along a line Y7-Y7 of FIG. 4.
Figure 8:
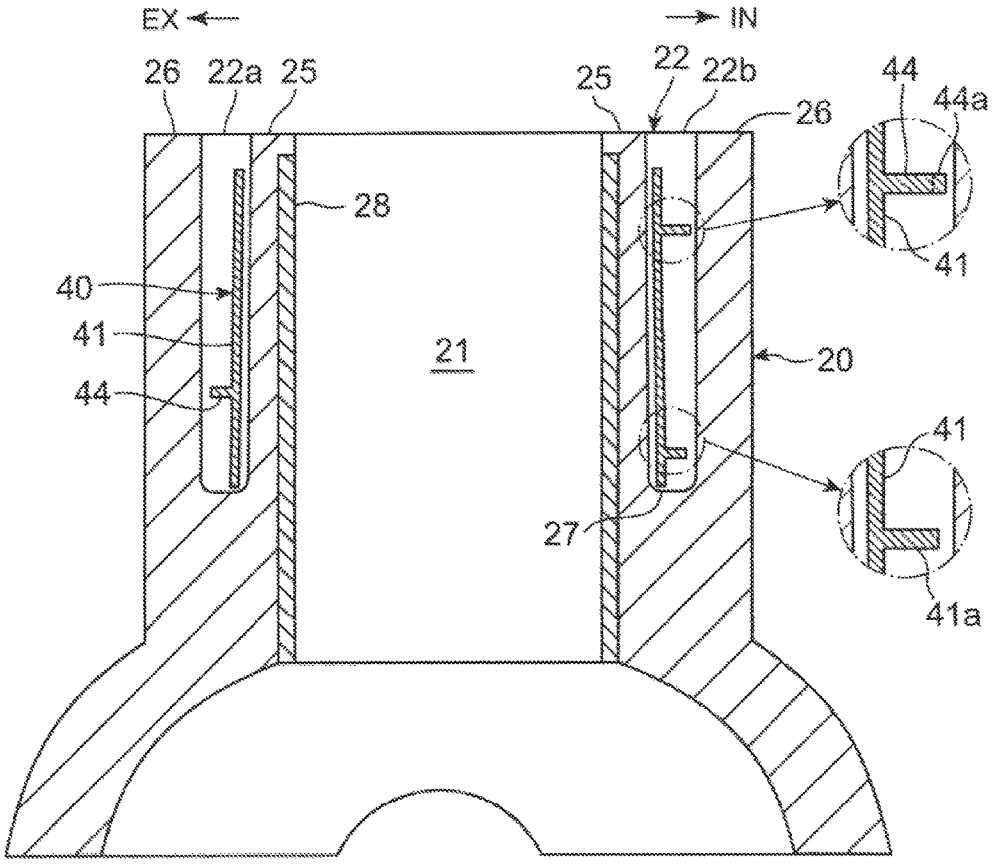
FIG. 8 is a cross-sectional view of the cylinder block taken along a line Y8-Y8 of FIG. 4.

As illustrated in FIGS. 3 to 8, the spacer 40 inserted into the water jacket 22 of the cylinder block 20 includes the vertical wall surface 41 to surround the cylinder bores 21 of the four cylinders #1 to #4, and is disposed between an inner wall 25 of the water jacket 22 of the cylinder block 20 and the outer wall 26 of the water jacket 22 of the cylinder block 20. Note that as illustrated in FIGS. 6 and 8, the inner wall 25 of the water jacket 22 of the cylinder block 20 is integrally formed with a liner 28 having wearing resistance.

Figure 9:
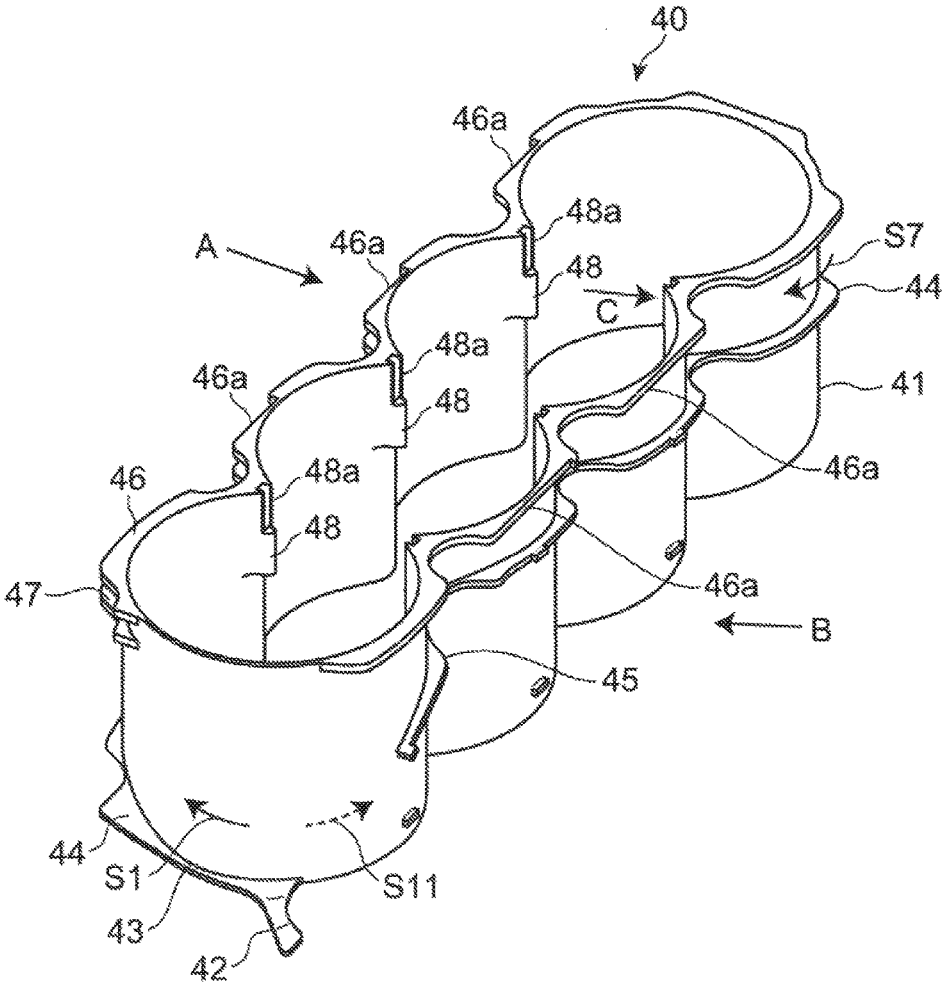
FIG. 9 is a perspective view illustrating the spacer.
Figure 10:
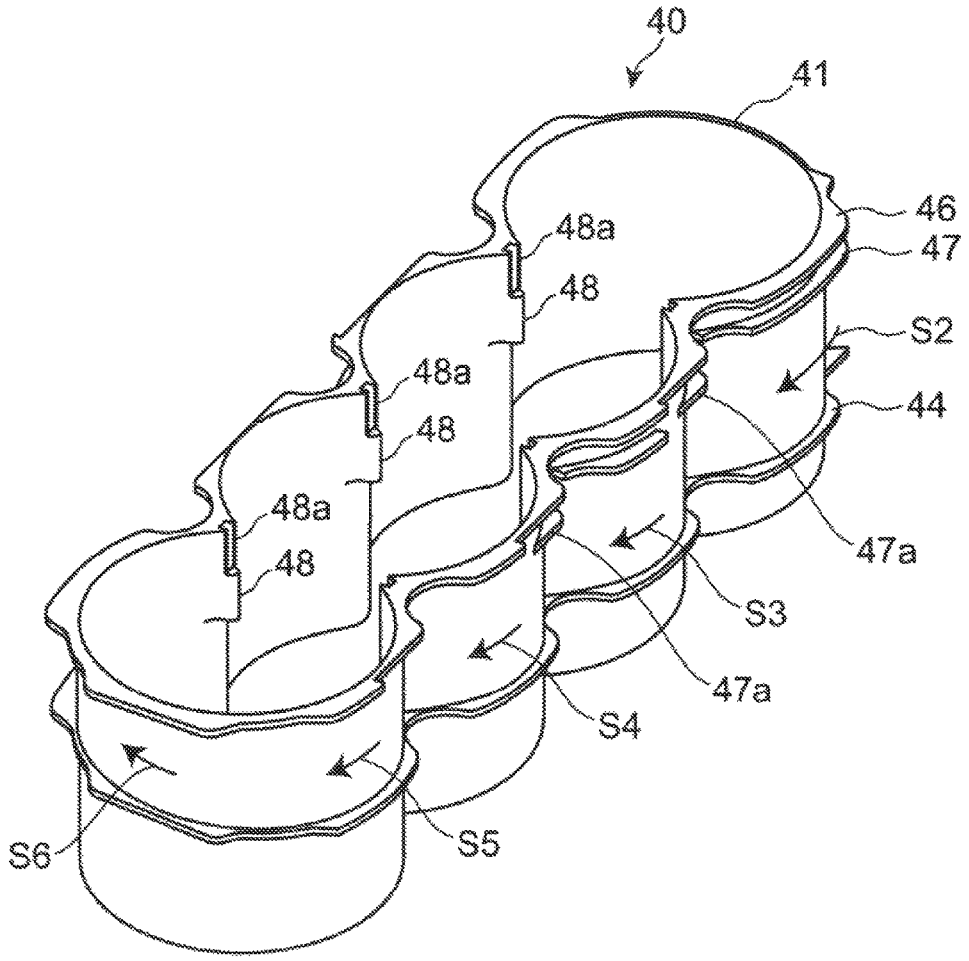
FIG. 10 is a perspective view illustrating the spacer seen in an A-direction of FIG. 9.
Figure 11:
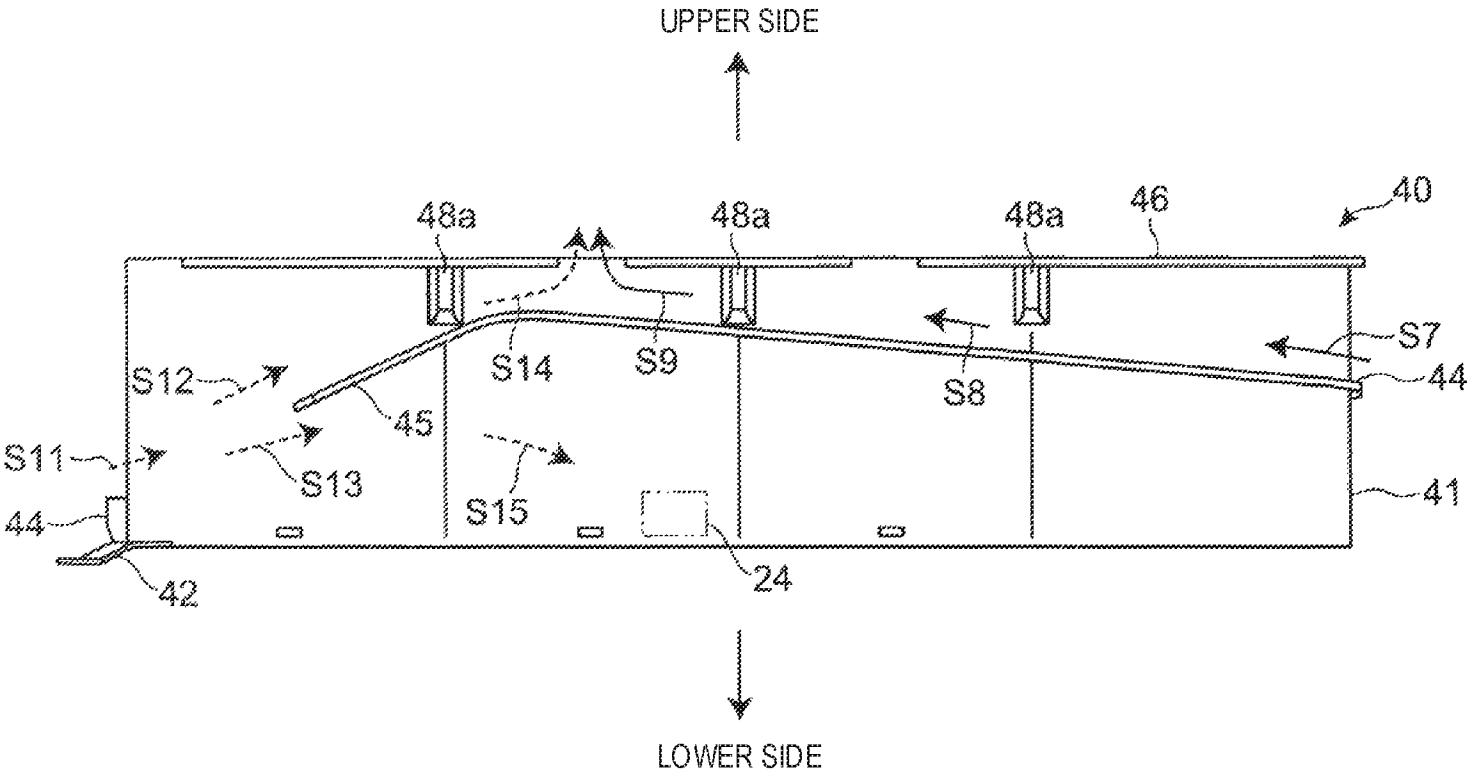
FIG. 11 is a front view of the spacer.
Figure 12:
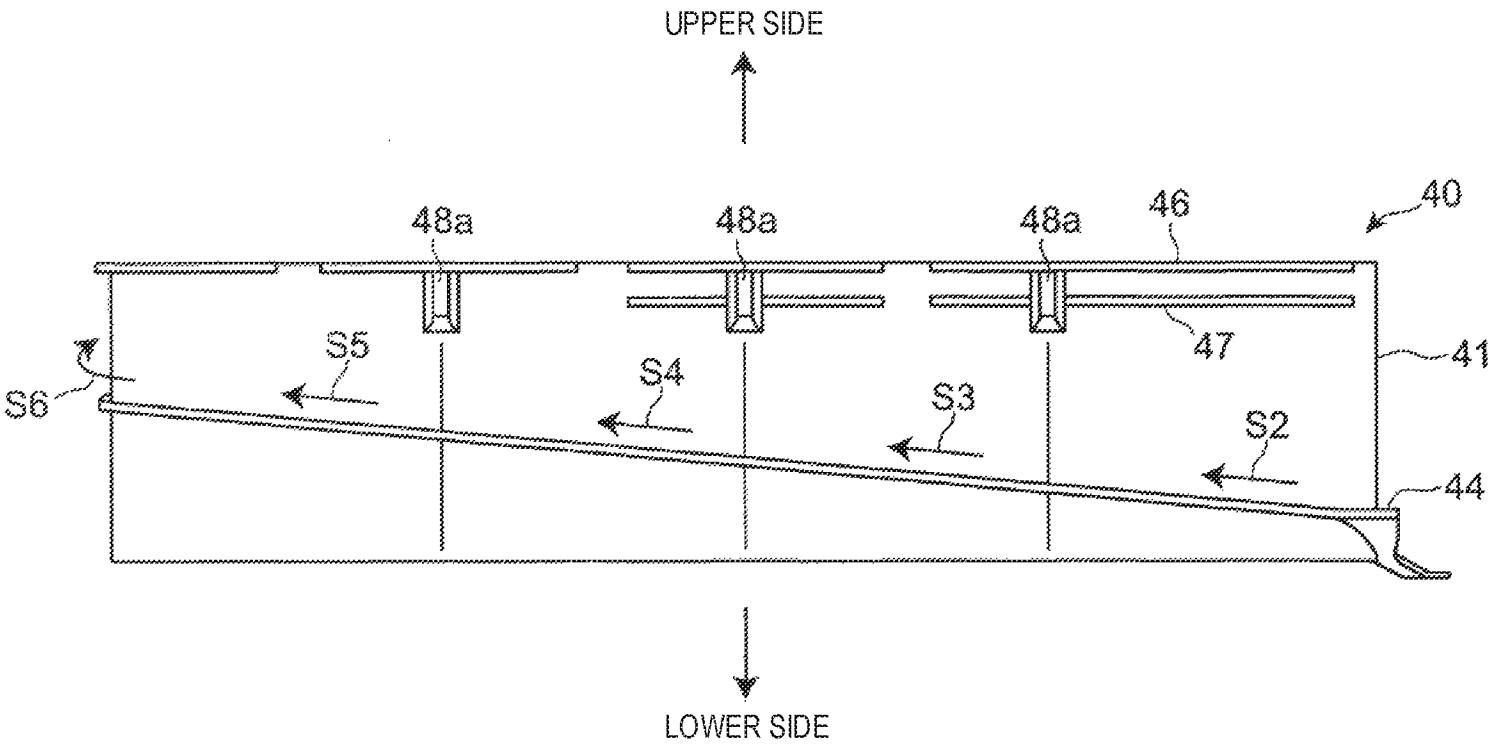
FIG. 12 is a rear view of the spacer.
Figure 13:
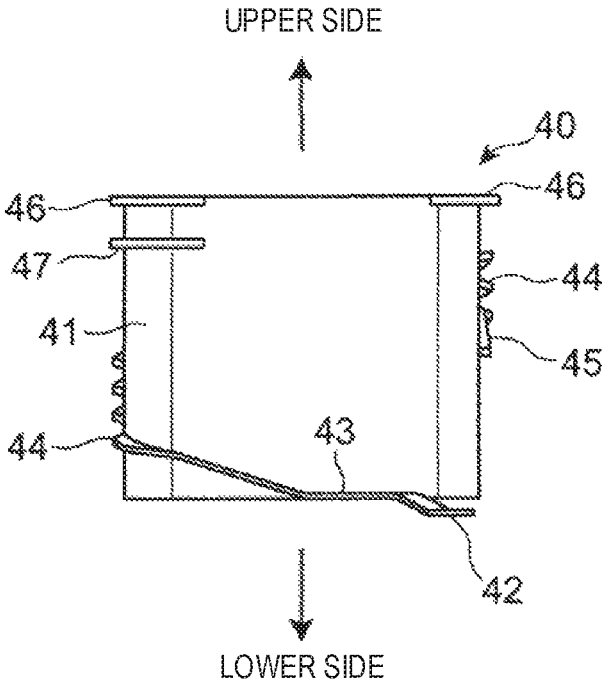
FIG. 13 is a left-side view of the spacer.
Figure 14:
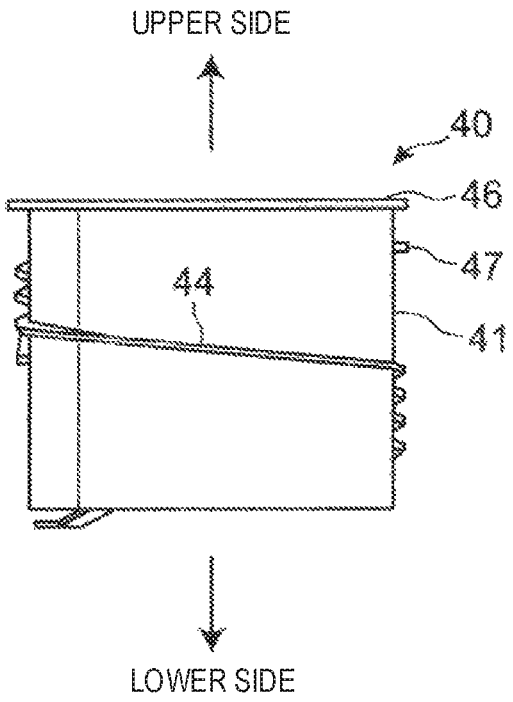
FIG. 14 is a right-side view of the spacer.

FIG. 9 is a perspective view illustrating the spacer. FIG. 10 is a perspective view illustrating the spacer seen in an A-direction of FIG. 9. FIG. 11 is a front view of the spacer. FIG. 12 is a rear view of the spacer. FIG. 13 is a left-side view of the spacer. FIG. 14 is a right-side view of the spacer.

As illustrated in FIGS. 9 to 14, the vertical wall surface 41 of the spacer 40 is formed annularly to surround the cylinder bores 21 of the four cylinders #1 to #4 and to extend vertically. A lower end part of the vertical wall surface 41 is provided with a guide part 42 at a position on the intake side and the first end side, at a position corresponding to the coolant inlet 23 of the cylinder block 20. The guide part 42 guides the coolant introduced from the coolant inlet 23 to flow around the vertical wall surface 41.

The guide part 42 is formed by a rib protruding outwardly from the vertical wall surface 41. As illustrated in FIG. 5, the guide part 42 extends obliquely outwardly from the lower end part of the vertical wall surface 41 along a bottom wall 27 of the water jacket 22 of the cylinder block 20, toward the coolant inlet 23 which is located at the position on the intake side and the first end side.

As described above, the water pump 3 is attached to the coolant inlet 23 formed in the outer wall 26, and the coolant inlet 23 and the water pump 3 are provided at the vertically same position (same height) as the bottom wall 27.

In this embodiment, the bottom wall 27 is formed with a concaved section 27*a* denting downward of the coolant inlet 23. The guide part 42 of the spacer 40 extends from the lower end part of the vertical wall surface 41 into the concaved section 27*a* formed in the bottom wall 27.

The guide part 42 includes an upper surface portion 42*a* extending substantially horizontally from the vertical wall surface 41 to the coolant inlet 23 side, an inclining portion 42*b* inclining downwardly while extending from the upper surface portion 42*a* to the coolant inlet 23 side, and a lower surface portion 42*c* extending substantially horizontally from the inclining portion 42*b* to the coolant inlet 23 side. Portions of the inclining portion 42*b* and the lower surface portion 42*c* on the coolant inlet 23 side are positioned in the concaved section 27*a*. The concaved section 27*a* formed in the bottom wall 27 is formed along the guide part 42 according to the shape of the guide part 42.

The coolant introduced from the coolant inlet 23 is guided to flow around the vertical wall surface 41 by the guide part 42 which is provided in the lower end part of the vertical wall surface 41 to extend along the bottom wall 27 of the water jacket 22 toward the coolant inlet 23.

In this embodiment, the guide part 42 extends obliquely to the intake side and the first end side from the lower end part of the vertical wall surface 41. The coolant introduced from the coolant inlet 23 is guided so that a major portion thereof flows to an exhaust-side section 22*a* of the water jacket 22 and a portion thereof flows to an intake-side section 22*b* of the water jacket 22.

The vertical wall surface 41 is also provided with a flange part 43 extending outwardly from the vertical wall surface 41 in a substantially horizontal direction, adjacently to the guide part 42 at the first end side of the lower end part of the vertical wall surface 41. The flange part 43 is formed corresponding to the shape of the outer wall 26 of the water jacket 22 so as to approach the outer wall 26 of the water jacket 22 of the cylinder block 20. The flange part 43 and the guide part 42 are formed continuously with each other in the lower end part of the vertical wall surface 41.

The spacer 40 also includes a rectifying part 44 extending outwardly from the vertical wall surface 41 adjacently to the flange part 43 provided to the lower end part of the vertical wall surface 41, so as to approach the outer wall 26 of the water jacket 22 of the cylinder block 20. The rectifying part 44 rectifies the flow of the coolant introduced from the coolant inlet 23.

When the spacer 40 is disposed in the water jacket 22 of the cylinder block 20, the rectifying part 44 inclines continuously upwardly at a fixed inclination as it extends from the first to second end side in the exhaust-side section 22*a* of the water jacket 22, further extends on the second end side from the exhaust-side section 22*a* to the intake-side section 22*b* of the water jacket 22, and then extends from the second end to first end side in the intake-side section 22*b* of the water jacket 22.

The rectifying part 44 rectifies the flow of the coolant flowing to the exhaust-side section 22*a* of the water jacket 22 from the first end side, so that the coolant flows around the outer circumferential side of the vertical wall surface 41 of the spacer 40 in a single direction, and further flows to an upper part of the water jacket 22 of the cylinder block 20. Since the rectifying part 44 inclines continuously at the fixed inclination, a coolant flow degradation due to a reduced flow rate on the outer circumferential side of the vertical wall surface 41 of the spacer 40 is prevented.

Moreover, the rectifying part 44 and the flange part 43 are formed continuously with each other in the vertical wall surface 41. Thus, compared to a case where the rectifying part 44 and the flange part 43 are separated from each other, a coolant flow into a section between the vertical wall surface 41 of the spacer 40 and the inner wall 25 of the water jacket 22 of the cylinder block 20 from the lower side of the spacer 40 is reduced.

The spacer 40 also has the plurality of openings 48*a* (e.g., six in this embodiment) at positions of an upper part of the vertical wall surface 41 corresponding to the inter-cylinder-bore portions 25*a* of the cylinder block 20, on the upper side of the rectifying part 44.

Figure 15:
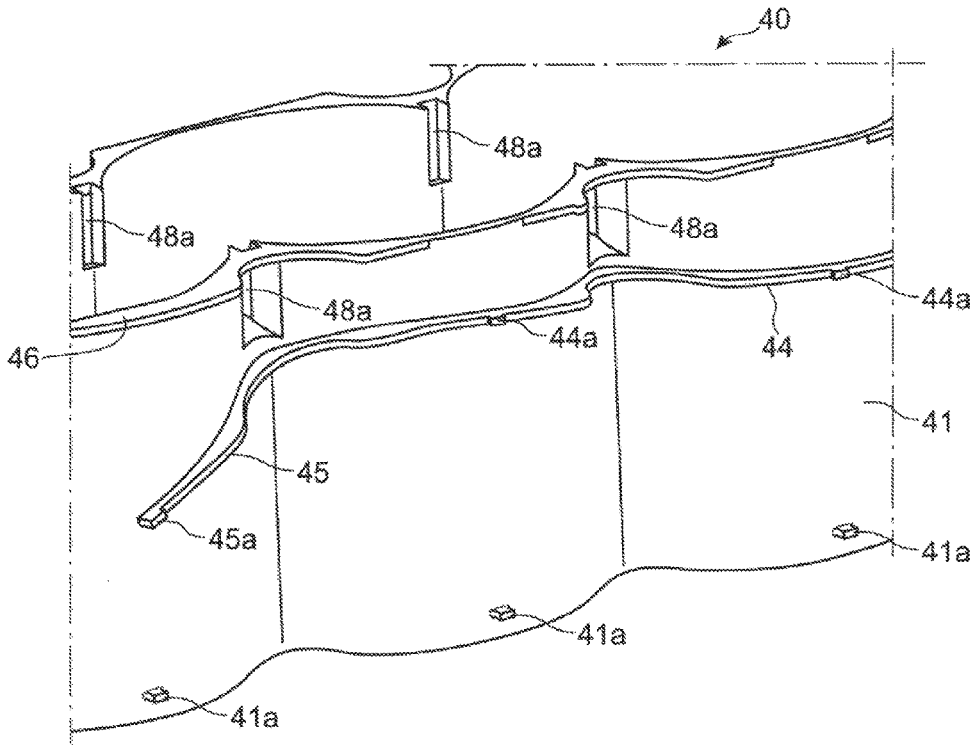
FIG. 15 is a view illustrating a substantial part of the spacer.
Figure 16:
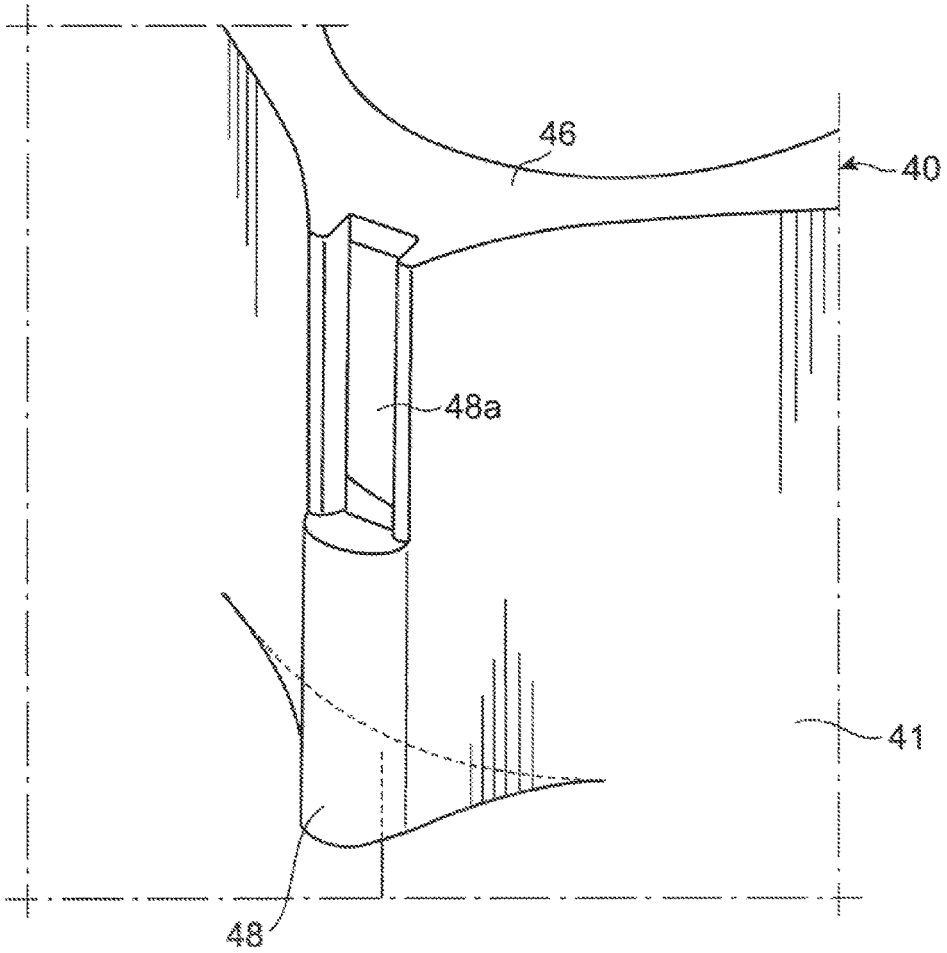
FIG. 16 is a view illustrating another substantial part of the spacer.

FIG. 15 is a view illustrating a substantial part of the spacer seen in a B-direction of FIG. 9. FIG. 16 is a view illustrating a different substantial part of the spacer seen in a C-direction of FIG. 9.

As illustrated in FIGS. 7, 15 and 16, the openings 48*a* formed in the vertical wall surface 41 open to the intake side and the exhaust side of the inter-cylinder-bore portions 25*a* of the cylinder block 20. Therefore, the coolant flowing on the outer circumferential side of the vertical wall surface 41 of the spacer 40 flows to the inner circumferential side thereof through the openings 48*a*. Thus, upper sections of the cylinder bores 21 are cooled more than lower sections thereof, and upper parts of the inter-cylinder-bore portions 25*a* of the cylinder block 20 are cooled.

In the vertical wall surface 41, protruding portions 48 protruding inwardly to approach the inner wall 25 of the water jacket 22 are formed on the lower side of the openings 48*a*. Each protruding portion 48 is provided in the upper part of the vertical wall surface 41 to have a given vertical length. Thus, while a weight increase of the spacer 40 is avoided, a downward flow of the coolant on the inner circumferential side of the vertical wall surface 41 of the spacer 40 through the openings 48*a* is reduced, and the upper sections of the cylinder bores 21 are effectively cooled.

As illustrated in FIGS. 4 and 7, upper end portions of the inter-cylinder-bore portions 25*a* of the cylinder block 20 are formed with concaved sections 25*b* at the intake and exhaust sides, to dent inwardly in directions perpendicular to the cylinder line-up direction and the vertical directions (hereinafter, these perpendicular directions are referred to as extending "laterally"). The openings 48*a* of the vertical wall surface 41 are provided corresponding to the concaved sections 25*b* formed in the inter-cylinder-bore portions 25*a* of the cylinder block 20.

For example, each of the concaved sections 25*b* formed in the inter-cylinder-bore portions 25*a* of the cylinder block 20 is comprised of a first concaved section 25*c* and a second concaved section 25*d*. The first concaved section 25*c* laterally dents inwardly, from one of the intake- and exhaust-side sections. The second concaved section 25*d* dents further inward of the first concaved section 25*c*. Therefore, the coolant flowing to the inner circumferential side of the vertical wall surface 41 of the spacer 40 through the openings 48*a*, flows toward the concaved sections 25*b* formed in the inter-cylinder-bore portions 25*a*, and effectively cools the inter-cylinder-bore portions 25*a* of the cylinder block 20.

The spacer 40 also includes a flange part 46 extending outwardly from the upper end part of the vertical wall surface 41 at positions corresponding to the exhaust-side section 22*a*, the second end side, and the intake-side section 22*b* of the water jacket 22, so as to approach the outer wall 26 of the water jacket 22 of the cylinder block 20. The flange part 46 is formed on the upper side of the openings 48*a* and extends in the cylinder line-up direction, over the openings 48*a* formed in the vertical wall surface 41.

As illustrated in FIG. 9, the flange part 46 is formed with cutout sections 46*a* by being cut in parts on the outer circumferential side to promote the flow of the coolant from the water jacket 22 of the cylinder block 20 to the cylinder head 30 through the communication holes 52 of the gasket 50. The cutout sections 46*a* are formed corresponding to the communication holes 52*b* disposed on the exhaust side of the second to fourth cylinders #2 to #4 and the communication holes 52*c* disposed on the intake side of the second and third cylinders #2 and #3.

The spacer 40 also includes a flange part 47 in the vertical wall surface 41 corresponding to the exhaust-side section 22*a* of the water jacket 22. The flange part 47 extends outwardly on the lower side of the flange part 46 formed in the upper end part of the vertical wall surface 41, to approach the outer wall 26 of the water jacket 22 of the cylinder block 20. The flange part 47 extends over the openings 48*a* formed in the vertical wall surface 41 in the cylinder line-up direction, is provided at the same height as the openings 48*a*, and is formed with parts corresponding to the openings 48*a* cut out.

As illustrated in FIG. 12, the flange part 47 is provided to extend substantially horizontally from both ends of two of the openings 48*a* in the cylinder line-up direction, the two of the openings 48*a* corresponding to the inter-cylinder-bore portion 25*a* between the first and second cylinders #1 and #2 and the inter-cylinder-bore portion 25*a* between the second and third cylinders #2 and #3, respectively.

As illustrated in FIG. 10, the flange part 47 is also formed with cutout sections 47*a* by being cut in parts on the outer circumferential side to promote the flow of the coolant flowing from the water jacket 22 of the cylinder block 20 to the cylinder head 30 through the communication holes 52 of the gasket 50. The cutout sections 47*a* are formed corresponding to the communication holes 52*b* disposed on the exhaust side of the second and third cylinders #2 and #3.

The spacer 40 includes the flange part 46 extending outwardly from the upper end part of the vertical wall surface 41, and the flange part 47 extending outwardly on the lower side of the flange part 46. Since the flange part 47 is provided at the same height as the openings 48*a* and cut out in parts corresponding to the openings 48*a*, a coolant flow into the section between the vertical wall surface 41 of the spacer 40 and the inner wall 25 of the water jacket 22 of the cylinder block 20 from the outer circumferential side of the vertical wall surface 41 through the upper side of the spacer 40 is reduced.

The spacer 40 also includes a flow dividing rib 45 in the vertical wall surface 41 corresponding to the intake-side section 22*b* of the water jacket 22. The flow dividing rib 45 extends outwardly from the vertical wall surface 41 to approach the outer wall 26 of the water jacket 22 of the cylinder block 20. The flow dividing rib 45 divides the flow of the coolant introduced from the coolant inlet 23 and flowing to the intake-side section 22*b* of the water jacket 22, into a flow toward the water jacket 32 of the cylinder head 30 through the communication holes 52 (specifically, the communication holes 52*c* disposed on the intake side of the second and third cylinders #2 and #3) and a flow toward the cylinder-block-side discharging section 24.

As illustrated in FIG. 11, the flow dividing rib 45 is spaced from the coolant inlet 23 (specifically, from the guide part 42 provided corresponding to the coolant inlet 23) to the second end side by a given distance. The flow dividing rib 45 inclines upwardly continuously at a fixed inclination as it extends from the first end to second end side.

The flow dividing rib 45 extends on the lower side of the openings 48*a* to the second end side from a center part of the vertical wall surface 41 in the vertical directions, at a position where the part of the vertical wall surface 41 corresponding to the first cylinder #1 laterally takes a maximum dimension. In the intake-side section 22*b* of the water jacket 22, one end of the rectifying part 44 on the first end side is coupled to the flow dividing rib 45 on the second end side.

Thus, the coolant introduced from the coolant inlet 23 and flowing to the intake-side section 22*b* of the water jacket 22 is vertically divided by the flow dividing rib 45, and the coolant stably flows to the water jacket 32 of the cylinder head 30 and the cylinder-block-side discharging section 24.

The path of the coolant after being introduced from the coolant inlet 23 and flowing in the intake-side section 22*b* of the water jacket 22 is switchable between the path in which the coolant flows to the water jacket 32 of the cylinder head 30 through the communication holes 52*c* as well as it flows to the cylinder-block-side discharging section 24, and the path in which the coolant flows to the water jacket 32 of the cylinder head 30 through the communication holes 52*c* and does not flow to the cylinder-block-side discharging section 24. Even when the path is switched, a change in the flow of the coolant on the upper side of the flow dividing rib 45 is prevented, and by preventing disturbance in the coolant flow, the coolant stably flows to the water jacket 32 of the cylinder head 30 and the cylinder-block-side discharging section 24.

As illustrated in FIG. 15, the spacer 40 also includes protrusions 41*a* protruding outwardly at the intake-side section 22*b* side of the lower part of the vertical wall surface 41, at positions where the parts of the vertical wall surface 41 surrounding the cylinder bores 21 of the first to third cylinders #1 to #3 laterally take maximum dimensions, respectively.

With the protrusions 41*a*, the lower part of the vertical wall surface 41 of the spacer 40 is prevented from contacting the cylinder-block-side discharging section 24 while preventing an increase in flow resistance of the coolant, and the path in which the coolant introduced from the coolant inlet 23 flows to the cylinder-block-side discharging section 24 is secured.

In the spacer 40, as illustrated in FIGS. 8 and 15, the rectifying part 44 and the flow dividing rib 45 provided at the intake-side section 22*b* side of the upper part of the vertical wall surface 41 are also formed with protrusions 44*a* and a protrusion 45*a*, respectively. The protrusions 44*a* protrude outwardly at positions where the parts of the vertical wall surface 41 surrounding the cylinder bores 21 of the second and third cylinders #2 and #3 laterally take maximum dimensions, respectively. The protrusion 45*a* protrudes outwardly at a position where the part of the vertical wall surface 41 surrounding the cylinder bore 21 of the first cylinder #1 laterally takes a maximum dimension.

Note that the spacer 40 is integrally formed by injection molding using a material, such as polyamide-based thermoplastic resin.

Next the flow of the coolant introduced into the water jacket 22 of the cylinder block 20 inserted therein the spacer 40 is described.

As indicated by the arrow S1 of FIG. 9, the coolant introduced into the first end side of the cylinder block 20 mainly flows to the exhaust-side section 22*a* of the water jacket 22. The coolant flows to the upper part of the exhaust-side section 22*a* of the water jacket 22 by the rectifying part 44.

As illustrated in FIG. 10, by the rectifying part 44, the coolant flowed to the exhaust-side section 22*a* of the water jacket 22 flows upwardly while flowing to the second end side in the exhaust-side section 22*a* of the water jacket 22 in the order of the arrows S2, S3, S4 and S5. The coolant flowed to the second end side flows to the intake-side section 22*b* of the water jacket 22 at the arrow S6 and flows upwardly.

As illustrated in FIGS. 9 and 11, by the rectifying part 44, the coolant flowed to the second end side of the intake-side section 22*b* of the water jacket 22 flows upwardly while flowing to the first end side in the intake-side section 22*b* of the water jacket 22 in the order of the arrows S7, S8 and S9. Then the coolant flows to the water jacket 32 of the cylinder head 30 through the communication holes 52*c*.

After the coolant is introduced from the first end side and flowed to the exhaust-side section 22*a* of the water jacket 22, when the coolant flows around the outer circumferential side of the vertical wall surface 41 of the spacer 40 in the single direction, it also flows to the inner circumferential side of the vertical wall surface 41 of the spacer 40 through the openings 48*a* formed in the upper part of the vertical wall surface 41 of the spacer 40, to cool the upper sections of the cylinder bores 21 and the inter-cylinder-bore portions 25*a*. The coolant flowed to the inner circumferential side of the vertical wall surface 41 of the spacer 40 flows to the water jacket 32 of the cylinder head 30 through the communication holes 52*d*.

Also in the case where the coolant flows to the inner circumferential side of the vertical wall surface 41 of the spacer 40 through the openings 48*a* as described above, the rectifying part 44 gradually reduces the cross-sectional area of the flow path of the coolant. Therefore, the degradation in the coolant flow due to the reduced flow rate of the coolant flowing on the outer circumferential side of the vertical wall surface 41 of the spacer 40 is prevented and the coolability of the coolant in the upper sections of the cylinder bores 21 is improved.

After the coolant is introduced from the first end side and flowed to the exhaust-side section 22*a* of the water jacket 22, when the coolant flows around the outer circumferential side of the vertical wall surface 41 of the spacer 40 in the single direction, it partially flows to the water jacket 32 of the cylinder head 30 through the communication holes 52*a*, 52*b* and 52*c*.

On the other hand, as indicated by the arrow S11 of FIG. 9, the coolant introduced into the first end side of the cylinder block 20, partially flows to the intake-side section 22*b* of the water jacket 22. When the flow rate control valve 5*b* connected with the cylinder-block-side discharging section 24 is in an open state, as illustrated in FIG. 11, the flow of this coolant is vertically divided by the flow dividing rib 45, into the flow on the upper side of the flow dividing rib 45 indicated by the arrow S12 and the flow on the lower side of the flow dividing rib 45 indicated by the arrow S13.

The coolant flowing on the upper side of the flow dividing rib 45 flows upwardly while flowing to the second end side in the intake-side section 22*b* of the water jacket 22 and, as indicated by the arrow S14, flows to the water jacket 32 of the cylinder head 30 through the communication holes 52*c*. The coolant flowing on the upper side of the flow dividing rib 45 partially flows to the inner circumferential side of the vertical wall surface 41 of the spacer 40 through the openings 48*a* formed in the upper part of the vertical wall surface 41, and cools the upper sections of the cylinder bores 21 and the inter-cylinder-bore portions 25*a*. The coolant flowed to the inner circumferential side of the vertical wall surface 41 flows to the water jacket 32 of the cylinder head 30 through the communication holes 52*d*.

On the other hand, the coolant flowing on the lower side of the flow dividing rib 45 flows to the second end side in the intake-side section 22*b* of the water jacket 22, and as indicated by the arrow S15, flows to the cylinder-block-side discharging section 24.

Figure 17:
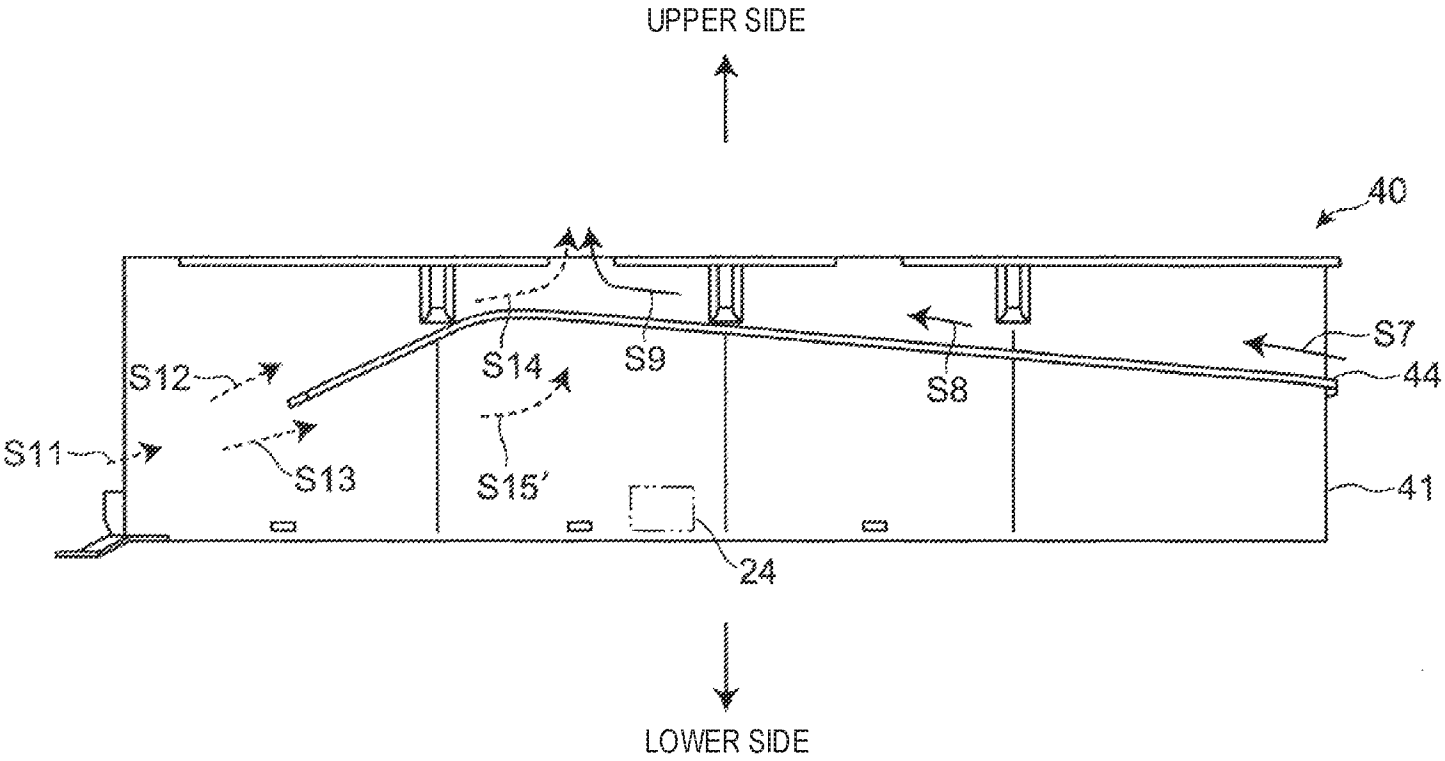
FIG. 17 is a view illustrating a flow of coolant when a flow rate control valve connected to a cylinder-block-side discharging section is in a closed state.

FIG. 17 is a view illustrating a flow of the coolant in a closed state of the flow rate control valve connected to the cylinder-block-side discharging section. As illustrated in FIG. 17, also when the flow rate control valve 5*b* is in the closed state, the coolant introduced from the first end side and flowed to the intake-side section 22*b* of the water jacket 22 is vertically divided, into the flow on the upper side of the flow dividing rib 45 indicated by the arrow S12 and the flow on the lower side of the flow dividing rib 45 indicated by the arrow S13.

Similar to when the flow rate control valve 5*b* is in the open state, the coolant flowing on the upper side of the flow dividing rib 45 flows upwardly while flowing to the second end side in the intake-side section 22*b* of the water jacket 22 and, as indicated by the arrow S14, flows to the water jacket 32 of the cylinder head 30 through the communication holes 52*c*. A part of the coolant flowing on the upper side of the flow dividing rib 45 flows to the inner circumferential side of the vertical wall surface 41 of the spacer 40 through the openings 48*a* formed in the upper part of the vertical wall surface 41 of the spacer 40.

On the other hand, although the coolant flowing on the lower side of the flow dividing rib 45 flows to the second end side in the intake-side section 22*b* of the water jacket 22, it does not flow to the cylinder-block-side discharging section 24 and, as indicated by the arrow S15', flows toward the water jacket 32 of the cylinder head 30.

In this embodiment, the coolant inlet 23 is formed at the first end side of the outer wall 26 of the intake-side section 22*b* of the water jacket 22 of the cylinder block 20; however, in the outer wall 26 of the intake-side portion 22*b*, the coolant inlet may be formed at the first end side in the exhaust-side portion 22*a* of the water jacket 22 of the cylinder block 20, and the cylinder-block-side discharging section may be formed in the center part in the exhaust-side portion 22*a*.

In such a case, the guide part provided to the vertical wall surface 41 of the spacer 40, similar to the guide part 42, is provided at a position on the exhaust side and the first end side corresponding to the coolant inlet. The guide part guides the coolant introduced from the coolant inlet to mainly flow to the intake-side section 22*b* of the water jacket 22, and partially flow to the exhaust-side section 22*a* of the water jacket 22.

The rectifying part provided to the vertical wall surface 41 of the spacer 40, similar to the rectifying part 44, inclines continuously upwardly as it extends from the first end to second end side in the intake-side section 22*b* of the water jacket 22, further extends on the second end side from the intake-side section 22*b* to the exhaust-side section 22*a* of the water jacket 22, and then extends from the second end to first end side in the exhaust-side section 22*a* of the water jacket 22.

The flow dividing rib provided to the vertical wall surface 41 of the spacer 40, similar to the flow dividing rib 45, vertically divides the flow of the coolant introduced from the coolant inlet and flowing in the exhaust-side section 22*a* of the water jacket 22, into the flow toward the water jacket 32 of the cylinder head 30 and the flow toward the cylinder-block-side discharging section 24.

As described above, with the cooling structure 1 of the engine according to this embodiment, in the lower end part of the vertical wall surface 41 of the spacer 40 inserted into the water jacket 22 of the cylinder block 20, the guide part 42 for guiding the coolant introduced from the coolant inlet 23 to flow around the vertical wall surface 41 is provided at the position corresponding to the coolant inlet 23 formed in the outer wall 26 of the water jacket 22 of the cylinder block 20. The guide part 42 extends outwardly from the lower end part of the vertical wall surface 41 toward the coolant inlet 23 along the bottom wall 27 of the water jacket 22 of the cylinder block 20.

Therefore, the guide part 42 guides the coolant introduced from the coolant inlet 23 to flow around the vertical wall surface 41. Thus, the downward flow of the coolant from the both sides of the guide part is reduced and the coolant flow into the section between the vertical wall surface 41 of the spacer 40 and the inner wall 25 of the water jacket 22 of the cylinder block 20 from the lower side of the spacer 40 is reduced.

The coolant inlet 23 and the water pump 3 are provided at the same height as the bottom wall 27. Thus, interference between the intake system and the exhaust system of the engine 2 is avoided. Additionally, when the water pump 3 is attached at the same height as the bottom wall 27, the flow of the coolant introduced from the coolant inlet 23, into the section between the vertical wall surface 41 of the spacer 40 and the inner wall 25 from the lower side of the spacer 40 is reduced.

The concaved section 27*a* denting downward of the coolant inlet 23 is formed in the bottom wall 27. The guide part 42 extends from the lower end part of the vertical wall surface 41 into the concaved section 27*a*. Thus, the coolant is guided to flow around the vertical wall surface 41 while preventing the increase in the flow resistance of the coolant introduced from the coolant inlet 23.

The guide part 42 includes the inclining portion 42*b* inclining downwardly as it extends toward the coolant inlet 23. The inclining portion 42*b* is provided so that the part on the coolant inlet 23 side is within the concaved section 27*a*. Thus, also when the spacer 40 vertically moves inside the water jacket 22, the increase in the flow resistance of the coolant introduced from the coolant inlet 23 is prevented.

The flange part 43 extending outwardly from the vertical wall surface 41 adjacently to the guide part 42 to approach the outer wall 26 is provided to the lower end part of the vertical wall surface 41. The flange part 43 and the guide part 42 are formed continuously with each other in the lower end part of the vertical wall surface 41. With the flange part 43 formed continuous to the guide part 42, the coolant flow into the section between the vertical wall surface 41 and the inner wall 25 from the lower side of the spacer 40 is effectively reduced.

The present invention is not limited to the illustrated embodiment, and various improvements and modifications in design may be made without deviating from the scope of the present invention.

As described above, according to the present invention, in engines, a coolant flow into a section between a vertical wall surface of a spacer and an inner wall of a water jacket of a cylinder block from the lower side of the spacer is reduced. Therefore, it is possible to suitably use the present invention in the technical fields of manufacturing vehicles on which engines are installed.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

2 Engine
3 Water Pump
20 Cylinder Block
21 Cylinder Bore
22 Water Jacket of Cylinder Block
23 Coolant Inlet
25 Inner Wall of Water Jacket
26 Outer Wall of Water Jacket
27 Bottom Wall of Water Jacket
27*a* Concaved Section of Bottom Wall of Water Jacket
40 Spacer
41 Vertical Wall Surface
42 Guide Part
42*b* Inclining Portion
43, 46, 47 Flange Part
44 Rectifying Part
#1, #2, #3, #4 Cylinder

What is claimed is:

1. A cooling structure of an engine, comprising:

a water jacket formed in a cylinder block to surround a cylinder bore of the engine;

a spacer having a vertical wall surface and inserted into the water jacket, and a coolant inlet formed in an outer wall of the water jacket, and for circulating to the water jacket coolant introduced from the coolant inlet, wherein the vertical wall surface surrounds the cylinder bore, the spacer includes a guide part provided at a position of a lower end part of the vertical wall surface corresponding to the coolant inlet, and for guiding the coolant introduced from the coolant inlet to flow around the vertical wall surface, the guide part extends outwardly from the lower end part of the vertical wall surface toward the coolant inlet along a bottom wall of the water jacket of the cylinder block, a concaved section is formed in the bottom wall of the water jacket of the cylinder block to dent downward of the coolant inlet, and the guide part extends into the concaved section from the lower end part of the vertical wall surface.

2. The cooling structure of claim 1, wherein a water pump is attached to the coolant inlet of the cylinder block, and wherein the coolant inlet and the water pump are provided at the same height as the bottom wall of the water jacket of the cylinder block.

3. The cooling structure of claim 1, wherein the guide part includes an inclining portion inclining downwardly while extending toward a coolant inlet side, and wherein the inclining portion is provided so that a part thereof on the coolant inlet side is disposed within the concaved section.

4. The cooling structure of claim 1, wherein the spacer includes a flange part disposed adjacently to the guide part in the lower end part of the vertical wall surface and extending outwardly from the vertical wall surface to approach the outer wall of the water jacket of the cylinder block, and wherein the flange part and the guide part are formed continuously with each other in the lower end part of the vertical wall surface.

* * * * *